United States Patent [19]

Bull

[11] Patent Number: 4,579,676

[45] Date of Patent: Apr. 1, 1986

[54] LOW-PHOSPHATE LIQUID CLEANING COMPOSITION

[75] Inventor: Sandra L. Bull, Eagan, Minn.

[73] Assignee: Economics Laboratory, Inc., St. Paul, Minn.

[21] Appl. No.: 682,654

[22] Filed: Dec. 17, 1984

[51] Int. Cl.[4] ..... C11D 3/395; C11D 7/54

[52] U.S. Cl. ..... 252/94; 252/95; 252/99; 252/103; 252/156; 252/174.16; 252/174.18; 252/186.26; 252/DIG. 14; 252/DIG. 17; 134/40

[58] Field of Search ..... 252/156, 174.18, 174.24, 252/94, 95, 99, 103, DIG. 14, DIG. 17, 174.16, 186.26; 134/40; 260/502.4 D

[56] References Cited

U.S. PATENT DOCUMENTS

| | | | |
|---|---|---|---|
| 3,579,455 | 5/1971 | Sabatelli et al. | 252/135 |
| 3,627,686 | 12/1971 | Sabatelli et al. | 257/527 |
| 3,671,440 | 6/1972 | Sabatelli et al. | 252/103 |
| 3,922,230 | 11/1975 | Lamberti et al. | 252/89 |
| 3,950,260 | 4/1976 | Eldib | 252/89 |
| 4,079,016 | 4/1978 | Brahm et al. | 252/99 |
| 4,147,650 | 4/1979 | Sabatelli et al. | 252/103 |
| 4,159,946 | 7/1979 | Smith et al. | 260/502.4 D |
| 4,203,858 | 5/1980 | Chakrabarti | 252/135 |
| 4,228,048 | 10/1980 | Tesdahl | 252/156 |

FOREIGN PATENT DOCUMENTS 869964 6/1961 United Kingdom .

OTHER PUBLICATIONS

Belsperse 161, Process Water Control Additive, Ciba-Geigy Technical Bulletin, 1983.

*Primary Examiner*—Paul Lieberman
*Assistant Examiner*—Hoa Van Le
*Attorney, Agent, or Firm*—Merchant, Gould, Smith, Edell, Welter & Schmidt

[57] ABSTRACT

Aqueous alkaline cleaning concentrates and wash solutions are disclosed which comprise an alkali metal hydroxide, a water-conditioning acrylic polymer, an active chlorine source and a fatty or oily soil-dispersing amount of a phosphinopolycarboxylic acid. The wash solutions are particularly useful to clean cleaned-in-place food-processing equipment which has been fouled with greasy or oily soils.

16 Claims, No Drawings

LOW-PHOSPHATE LIQUID CLEANING COMPOSITION

FIELD OF THE INVENTION

The present invention relates to aqueous alkaline cleaning solutions comprising an alkali metal hydroxide, a water-soluble acrylic polymer, an active chlorine source and a phosphinopolycarboxylic acid.

BACKGROUND OF THE INVENTION

The presence of oily and fatty substances such as meat, fish or dairy products on food storage, processing and preparation equipment presents special problems in detergent formulation and application. Alkali metal hydroxide solutions can degrade fats and oils by saponification reactions and are commonly employed in combination with water-conditioning condensed phosphates such as sodium tripolyphosphates, which also act to disperse or emulsify fatty soils. However, in recent years, the use of high concentrations of phosphate in detergents has come under increasing attack due to environmental concerns, and the permissible phosphate content of cleaning compositions has been severely limited by many states or municipalities, e.g., to no more than 0.5%.

Although water-soluble or dispersible polymers, such as those disclosed in U.S. Pat. No. 3,671,440, have been used to replace phosphate salts as water-conditioners, such polymers have not served as effective phosphate substitutes insofar as fat dispersal is concerned. Also, polyacrylic acids exhibit varying degrees of instability in chlorinated detergents and can substantially degrade the chlorine content of such compositions. Organic solvents and/or synthetic surfactants can act to disperse or emulsify fatty oils, but are often unstable in highly alkaline cleaning systems at effective concentrations or too toxic for use in the food-processing industry.

Therefore a need exists for aqueous highly-alkaline cleaning solutions which will both disperse and degrade deposits of fatty or oily soils on articles such as food-processing equipment or utensils, in the presence of substantial water hardness factors.

BRIEF DESCRIPTION OF THE INVENTION

The present invention is directed to a low-phosphorous aqueous cleaning composition which can be formulated as a water-dilutable aqueous concentrate comprising an alkali metal hydroxide, a source of active chlorine, a water-conditioning acrylic polymer and a phosphinopolycarboxylic acid. The phosphinopolycarboxylic acid component is selected to be water-soluble and can be employed in dilutable concentrates in amounts at which the concentrates will generally be considered to be "low phosphorous," "low phosphate" or "phosphate-free", e.g. which comprise less than about 0.5% phosphate. When diluted to about 0.2–5% with water the present concentrates afford wash solutions effective to cleanse articles fouled with fatty and/or greasy soils, such as those comprising lard, tallow, butterfat, fish oil and the like. Such wash solutions are particularly useful when employed in recirculating cleaned-in-place systems, but may also be used to form soaking baths or in systems designed for surface application.

DETAILED DESCRIPTION OF THE INVENTION

For ease of handling and shipping, the aqueous cleaning compositions of the present invention are preferably prepared as concentrated solutions which can be diluted to the desired concentration with water at the end-use locus. These concentrates are prepared by dissolving the various components in a major proportion of water, preferably in soft water having a hardness of no more than about 1–2 grains of hardness/gallon (0.015–0.035 g/l).

The present concentrates will comprise an amount of an alkali metal hydroxide, preferably sodium hydroxide, potassium hydroxide or mixtures thereof, effective to degrade the greasy soils commonly encountered in the food-processing industry. The sodium or potassium hydroxide can be employed in either the liquid (about a 10–60% aqueous solution) or in the solid (powdered or pellet form). The preferred form is commercially-available sodium hydroxide, which can be obtained in aqueous solution at a concentration of about 50 wt-% and in a variety of solid forms of varying particle sizes.

The alkaline cleaning compositions of this invention can also contain a source of available chlorine which acts as a biocidal or destaining agent. Both organic and inorganic sources of available chlorine are useful, including alkali metal and alkaline earth metal hypochlorites, hypochlorite addition products, chloramines, chlorimines, chloramides, and chlorimides. Specific examples of compounds of this type include sodium hypochlorite, potassium hypochlorite, monobasic calcium hypochlorite, dibasic magnesium hypochlorite, chlorinated trisodium phosphate dodecahydrate, potassium dichloroisocyanurate, trichlorocyanuric acid, sodium dichloroisocyanurate dihydrate, 1,3-dichloro-5,5-dimethylhydantoin, N-chlorosulfamide, Chloramine T, Dichloramine T, Chloramine B and Dichloramine B. The preferred class of sources of available chlorine comprise inorganic chlorine sources such as sodium hypochlorite, monobasic calcium hypochlorite, dibasic calciium hypochlorite, monobasic magnesium hypochlorite, dibasic magnesium hypochlorite, and mixtures thereof. The most preferred sources of available chlorine include sodium hypochlorite and mono- and dibasic calcium hypochlorite, for reasons of availability, stability and highly effective disinfectant action.

The present compositions will also incorporate a water soluble acrylic polymer which can act to condition the wash solutions under end-use conditions. Such polymers include polyacrylic acid, polymethacrylic acid, acrylic acid-methacrylic acid copolymers, hydrolyzed polyacrylamide, hydrolyzed polymethacrylamide, hydrolyzed acrylamidemethacrylamide copolymers, hydrolyzed polyacrylonitrile, hydrolyzed polymethacrylonitrile, hydrolyzed acrylonitrilemethacrylonitrile copolymers, or mixtures thereof. Water-soluble salts or partial salts of these polymers such as the respective alkali metal (e.g. sodium, potassium) or ammonium salts can also be used. The weight average molecular weight of the polymers is from about 500 to about 15,000 and is preferably within the range of from 750 to 10,000. Preferred polymers include polyacrylic acid, the partial sodium salt of polyacrylic acid or sodium polyacrylate having weight average molecular weights within the range of 1,000 to 6,000. These polymers are commercially available, and methods for their preparation are well-known in the art.

For example, commercially-available water-conditioning polyacrylate solutions useful in the present cleaning solutions include the sodium polyacrylate solution, Colloid ®207 (Colloids, Inc., Newark, N.J.); the polyacrylic acid solution, Aquatreat ®AR-602-A (Alco Chemical Corp., Chattanooga, Tenn.); the polyacrylic acid solutions (50–65% solids) and the sodium polyacrylate powders (m.w. 2,100 and 6,000) and solutions (45% solids) available as the Goodrite ®K-700 series from B. F. Goodrich Co.; and the sodium- or partial sodium salts of polyacrylic acid solutions (m.w. 1000–4500) available as the Acrysol ® series from Rohm and Haas.

The present cleaning solutions will also comprise an effective grease-dispersing amount of a water-soluble phosphinopolycarboxylic acid. These materials, which may also be referred to as "phosphinoacrylic polymers," are formally the condensation products of low molecular weight, unsaturated monomers, such as those used to form the acrylic polymers described above, with sodium hypophosphite.

For example, acrylic acid-based polymers have the general formula: $H—[CH(CO_2H)CH_2]_nP(=O)OH[CH_2CH(CO_2H)]_m—H$ wherein the molecular weight and ratio of propionic acid units to the —P=O(OH)— unit may be varied over a wide range. For example, n+m may vary from about 3–4 to about 70–75. Commercially-available phosphinopolycarboxylic acids having weight ratios of total polyacrylic acid to phosphinoxy of from about 3:1 to 35:1 and molecular weights of about 200–5000, preferably about 250–3000, are useful in the present invention. An especially-preferred material is the phosphinopolycarboxylic acid available as Belperse ®161 from Ciba-Geigy as a 46–52% aqueous solution (m.w. about 1200).

Although phosphinopolycarboxylic acids have been disclosed to be useful as process water deposit control additives to control inorganic mineral scales, it has surprisingly been discovered that when used as additives to the present alkaline, polyacrylics-containing cleaners, these materials are highly effective to disperse natural or synthetic fats and oils such as lard, tallow, butterfat, fish oils, vegetable oils and the like. Furthermore, these phosphinopolycarboxylic acids are highly stable in the presence of active chlorine and alkali. Since the phosphorous content of these substances is much lower than the phosphorous content of the inorganic condensed phosphate salts such as sodium tripolyphosphate, the polymers can be used in relatively large amounts, if necessary, without exceeding the phosphate limits imposed on effluent discharges. For example, the phosphorous content of Belperse ®161 is only 0.86%. See, "Belperse ®161," Ciba-Geigy Technical Bulletin, Ardsley, N.Y. (1983), which is incorporated by reference herein.

For some cleaning operations, such as soak or surface applications, it may be desirable to add minor but effective amounts of alkali-stable synthetic organic surfactants, which may be selected from any of the known surfactant classes which are water-miscible and chemically-compatible. Preferred for use in the present systems are the anionic and nonionic surfactants, including the foam-forming amine oxides (available as the NINOX ® series from Stephan Chemical Co.).

Therefore, the liquid concentrates of the present invention will comprise about 5–35%, preferably about 10–20% sodium or potassium hydroxide, about 50–90%, preferably about 60–85% total water, about 0.5–15% of a water-soluble polyacrylic acid, polyacrylic acid salt or mixtures thereof, a source of active chlorine effective to provide about 1–10%, preferably about 2–5% available chlorine; and about 0.05–15%, preferably about 0.1–10% of a phosphinopolycarboxylic acid of a molecular weight of about 200–5000. Preferably the available chlorine will be provided by incorporating about 2–5% sodium hypochlorite into the concentrate.

The present aqueous concentrates may be readily prepared by adding an aqueous solution of the alkali metal hydroxide to soft water held in a polyvinylchloride or rubber-lined mixing tank and agitated with a stainless steel impeller. The acrylic polymer and the phosphinopolycarboxylic acid are then added, preferably as aqueous solutions, followed by the active chlorine source, such as a solution of a hypochlorite salt in water. After thorough mixing at ambient temperatures, the solution is passed through a screen and used to fill the appropriate containers, e.g. 1–50 gallon high density polyethylene bottles or lined drums.

When diluted with water to a concentration about 0.1–10%, preferably about 0.2–5%, the present concentrates yield wash solutions which are particularly well-suited for use in CIP (cleaned-in-place) equipment of the type employed throughout the food-processing industry.

Cleaning-in-place procedures involve the cleaning and sanitizing of storage and/or processing equipment and piping in its assembled condition by recirculation of the necessary rinse, detergent and sanitizing solution through the equipment under appropriate conditions of time, temperature, detergency, and mechanical action. Recirculation is a necessary condition for CIP cleaning. In many cases, the detergent wash solution that is recirculated for cleaning is used over and over throughout a day or more. This type of a system is called "re-use CIP cleaning." In re-use CIP cleaning, generally a large stainless steel tank, with a capacity of holding 200–500 gallons of solution, is used to prepare the diluted wash solution. This same solution can be used to clean several different processing tanks and lines. Preferably the diluted wash solution will be applied to the soiled equipment at an elevated temperature, e.g. at about 50°–75° C.

The present invention will be further described by reference to the following detailed examples.

EXAMPLE I

Phosphinopolycarboxylic Acid Concentrate

A polyvinylchloride-lined mixing vessel was charged with 2350 ml of soft water and moderate stirring initiated. Aqueous sodium hydroxide (50%, 2175 g) was added slowly, followed by 435 g of aqueous sodium polyacrylate (m.w. 4500, 45% solids), 116 g of Belsperse ®161 (50% active phosphinopolycarboxylic acid) and 2175 g of 10% aqueous sodium hypochlorite (8% available chlorine). The resulting solution was mixed until homogeneous, filtered through an 80-mesh stainless steel screen and stored in a 1 gallon vented polyethylene bottle.

EXAMPLES II–VII

Table I summarizes the composition of additional liquid concentrates which were prepared according to the procedure of Example I.

TABLE I

| Cleaning Concentrates | | | | | | |
|---|---|---|---|---|---|---|
| | Example (Final Wt. % Active Ingredient) | | | | | |
| Ingredient | II | III | IV | V | VI | VII |
| Sodium Hydroxide | 15.0 | 15.0 | 15.0 | 15.0 | 15.0 | 15.0 |
| Sodium Polyacrylate | 3.15 | 2.7 | 1.35 | 0.9 | 1.8 | 2.7 |
| Belsperse ® 161 | — | 0.3 | 1.0 | 1.5 | 0.5 | 3.0 |
| Sodium Hypochlorite | 3.0 | 3.0 | 3.0 | 3.0 | 3.0 | 3.0 |
| Water | q.s. | q.s. | q.s. | q.s. | q.s. | q.s. |

COMPARATIVE GREASE DISPERSION TESTS

Three liter portions of wash solutions were prepared by diluting each of the concentrates of Examples I–VII to a concentrate of 0.3% with semi-hard water (15 grains of hardness per gallon). The wash solution was heated to 68°–70° C. in a 6.0 l beaker equipped with a recirculating pump and hot plate heating. A 12.7 cm × 12.7 cm stainless steel 304 or 316 panel was immersed halfway into the solution to be tested. Half-and-half milk (30 ml) was added and the mixture recirculated for 30 minutes at 6.0 psi at 68°–70° C. The recirculation was stopped for 30 minutes, then another 30 ml of milk was added and recirculation commenced. After 4 on-off cycles were completed, the panel was removed from the solution, rinsed with water and greasiness evaluated visually, using the following criteria:

1 = No film or greasy build-up (soil line at air-liquid interface)

2 = Light film, some build-up

3 = Heavy film and greasy build-up

Table II summarizes the results of these tests.

TABLE II

| Panel Degreasing Tests | |
|---|---|
| Formula of Ex. | Degree of Filming |
| I | 1 |
| III | 2 |
| IV | 1 |
| V | 1 |
| VI | 2 |
| VII | 1 |
| II | 3 |

As demonstrated by Table II, wash solutions prepared by diluting concentrates comprising 1.0–3.0% of phosphinopolycarboxylic acid are capable of completely de-greasing fouled metal surfaces. Concentrates comprising 0.3% and 0.5% of the phosphino-polymer also exhibit substantially improved grease dispersion power over the concentrate formed without the phosphino-polymer (Ex. II).

COMPARATIVE FIELD TESTS

Based on the improved results observed in the laboratory de-greasing studies, field trials were carried out to evaluate the improvements in cleaning. Tables III and IV summarize the work completed at two dairy plants where a re-use CIP system is used.

TABLE III

| Tanker Truck Cleaning |
|---|
| A. Cleaning Conditions Prior to the Addition of the Phosphinopolycarboxylic Acid:<br>(a) Wash solution concentration: Concentrate of Ex. II at 0.49% (100 ppm chlorine)<br>Wash temperature: 65° C.<br>Wash time: 10.5 minutes<br>Results: Excessive fat floating on top of the CIP solution. |

TABLE III-continued

| Tanker Truck Cleaning |
|---|
| B. Cleaning Conditions with Various Levels of Phosphinopolycarboxylic Acid:<br>(a) Wash solution concentration: Concentrate of Ex. I at 0.28% (60 ppm chlorine and 10 ppm phosphinopolycarboxylic Acid).<br>Wash temperature: 65° C.<br>Wash time: 10.5 minutes<br>Results: Solution has small particles of fat floating and a very slight fat film floating on top of the CIP solution. A substantial improvement over the previous cleaning conditions.<br>(b) Wash solution concentration: Concentrate of Ex. V at 0.28% (70 ppm chlorine and 20 ppm phosphinopolycarboxylic Acid).<br>Wash temperature: 65° C.<br>Wash time: 10.5 minutes<br>Results: Several cleaning cycles were completed before fat-like material began to form on top of the CIP solution.<br>(c) Wash solution concentration: Concentrate of Ex. VII at 0.32% (80 ppm chlorine and 98 ppm phosphinopolycarboxylic Acid).<br>Wash temperature: 65° C.<br>Wash time: 10.5 minutes<br>Results: No fat particles or greasy film floating on top of the CIP solution. |

TABLE IV

| Raw Milk Storage Tank Cleaning |
|---|
| A. Cleaning Conditions Prior to the Addition of the Phosphinopolycarboxylic Acid:<br>(a) Wash solution concentration: Concentrate of Ex. II at 0.51% (60 ppm chlorine).<br>Wash temperature: 65° C.<br>Wash time: 15 minutes<br>Results: Heavy beading on all tank walls and fat floating on top of CIP solution.<br>B. Cleaning Conditions after the Addition of the Phosphinopolycarboxylic Acid:<br>(a) Wash solution concentration: Concentrate of Ex. I at 0.28% (60 ppm chlorine and 10 ppm phosphinopolycarboxylic Acid).<br>Wash temperature: 95° C.<br>Wash time: 15 minutes<br>Results: Substantial decrease in the beading of tanks and fat floating on the solution. |

The invention has been described with reference to various specific and preferred embodiments and techniques. However, it should be understood that many variations and modifications may be made while remaining within the spirit and scope of the invention.

What is claimed is:

1. A process for cleaning an article fouled with fatty or oily soil comprising:

(A) dissolving about 0.1–5.0 parts by weight of a liquid cleaning concentrate in about 100 parts by weight of water to form an aqueous wash solution said concentrate comprising: a solution of (a) about 5–35% of an alkali metal hydroxide;

(b) about 0.5–15% of a water-soluble acrylic polymer having a molecular weight of about 1,000–15,000;

(c) an amount of an active chlorine source effective to provide the concentrate with about 2–10% available chlorine;

(d) an amount of a phosphinopolycarboxylic acid effective to disperse fatty or oily soil;

(e) about 50–90% water; and (B) contacting said aqueous wash solution of (A) with the fouled article for a period of time effective to disperse said fatty or oily soil.

2. The process of claim 1 wherein the aqueous wash solution is applied to said articles at about 50°–75° C.

3. The process of claim 1 wherein the phosphinopolycarboxylic acid is present in the cleaning concentrate at a concentration of about 0.05–15% and has a molecular weight of about 200–5000.

4. The process of claim 1 wherein the alkali metal hydroxide comprises sodium hydroxide, potassium hydroxide or mixtures thereof.

5. The process of claim 1 wherein the active chlorine source comprises an alkali metal hypochlorite.

6. The process of claim 1 which is a cleaning-in-place process.

7. An aqueous alkaline cleaning concentrate effective to disperse and degrade fatty or oily soil comprising: a solution of (a) about 5–35% of an alkali metal hydroxide;

(b) about 0.5–15% of a water-conditioning acrylic polymer having a molecular weight of about 1,000–15,000;

(c) an amount of an active chlorine source effective to provide the concentrate with about 2–10% available chlorine;

(d) about 0.05–15% of a water-soluble phosphinopolycarboxylic acid having a molecular weight of about 250–5000; and (e) about 50–90% water.

8. The cleaning concentrate of claim 7 wherein said phosphinopolycarboxylic salt comprises a phosphinopolyacrylic acid.

9. The cleaning concentrate of claim 7 wherein the alkali metal hydroxide comprises sodium hydroxide, potassium hydroxide or mixtures thereof.

10. The cleaning concentrate of claim 7 wherein said acrylic polymer comprises polyacrylic acid, the partial sodium salt of polyacrylic acid, sodium polyacrylate or mixtures thereof.

11. The cleaning composition of claim 10 wherein the molecular weight of said acrylic polymer is about 2,000–10,000.

12. The cleaning concentrate of claim 7 wherein said active chlorine sources comprises an alkali metal hypochlorite.

13. The cleaning concentrate of claim 12 which comprises about 2–5% sodium hypochlorite.

14. An aqueous alkaline cleaning concentrate effective to disperse and degrade fatty or oily soil comprising: a solution of (a) about 10–20% sodium hydroxide, potassium hydroxide or mixtures thereof;

(b) about 1–10% of an acrylic polymer comprising polyacrylic acid, the partial sodium salt of polyacrylic acid or sodium polyacrylate having a molecular weight of about 1000–6000;

(c) an amount of sodium hypochlorite or calcium hypochlorite effective to provide about 2–10% available chlorine;

(d) about 0.1–6% of a phosphinoacrylic polymer having a molecular weight of about 200–5000 and a weight ratio of polyacrylic acid to phosphinoxy units of from about 3:1 to 35:1; and (e) about 50–90% water.

15. A wash solution formed by diluting the concentrate of claim 7 to about 0.1–10% with water.

16. A wash solution formed by diluting the concentrate of claim 14 to about 0.2–5% with water.

* * * * *